US006491471B1

(12) United States Patent
Susinskas

(10) Patent No.: US 6,491,471 B1
(45) Date of Patent: Dec. 10, 2002

(54) REINFORCED EPDM WALKWAYS

(76) Inventor: Robert J. Susinskas, 13989 Marilyn Ct., Carmel, IN (US) 46032

( * ) Notice: Subject to any disclaimer, the term of this patent is extended or adjusted under 35 U.S.C. 154(b) by 0 days.

(21) Appl. No.: 08/797,274

(22) Filed: Feb. 7, 1997

(51) Int. Cl.[7] ..... E04B 1/00; E04G 21/00; E01C 5/00

(52) U.S. Cl. ..... 404/73; 52/746.1; 52/746.11

(58) Field of Search ..... 404/17, 32, 73, 404/72; 52/273, 408, 741.4, 746.1, 746.11

(56) References Cited

U.S. PATENT DOCUMENTS

| | | | | | |
|---|---|---|---|---|---|
| 4,284,366 | A | * | 8/1981 | Lucik | 404/44 |
| 4,684,288 | A | * | 8/1987 | Chaps | 404/73 |
| 4,932,171 | A | * | 6/1990 | Beattie | 52/273 |
| 5,322,724 | A | * | 6/1994 | Levens | 428/57 |
| 5,496,615 | A | * | 3/1996 | Bartlett et al. | 428/144 |
| 5,512,118 | A | * | 4/1996 | Davis et al. | 156/157 |
| 5,563,217 | A | * | 10/1996 | Davis et al. | 428/323 |
| 5,593,748 | A | * | 1/1997 | Hubbard | 428/343 |
| 5,720,147 | A | * | 2/1998 | Wenrick et al. | 52/741.4 |
| 6,004,645 | A | * | 12/1999 | Hubbard | 428/119 |
| 6,071,996 | A | * | 6/2000 | Davis et al. | 524/482 |
| 6,080,458 | A | * | 6/2000 | Russell et al. | 428/354 |

FOREIGN PATENT DOCUMENTS

| | | | | |
|---|---|---|---|---|
| JP | 53-123523 | * | 10/1978 | 404/32 |

* cited by examiner

*Primary Examiner*—Gary S. Hartmann
(74) *Attorney, Agent, or Firm*—Clifford W. Browning; Woodard, Emhardt, Naughton, Moriarty & McNett

(57) ABSTRACT

A reinforced elastomeric membrane installed over a new, or existing, non-reinforced waterproof elastomeric membrane of a roof covering and the method of installing the reinforced elastomeric membrane in a continuous and watertight condition that will offer more continuous puncture resistance than current art. The overlapped edge portions of the two membranes (i.e. the new or existing EPDM membrane and the new reinforced EPDM membrane) are sealed together by an intervening adhesive layer. Using reinforced EPDM as walkways to, around, and between serviceable roof top curb units, roof hatches, and roof access points, on new or existing non-reinforced EPDM roofs, provides a greater degree of continuous protection than current art. Using reinforced EPDM as walkways to, around, and between serviceable rooftop curb units, roof hatches, and roof access points provides: a) a reinforcement where it is not currently available; b) permits the continuous walkway to be sealed to a water tight condition; c) is significantly less expensive per square foot than current methods; and d) provides a method of mechanical attachment for the walkway system that is not available with current methods.

10 Claims, 3 Drawing Sheets

REINFORCED EPDM WALKWAYS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

The present invention relates to composition and methods useful for protecting new and existing sheeting material used for low slope roofing. More particularly the sheeting material comprised of ethylene-propylene-deine-monomer, referred to herein as EPDM. Even more particularly, the invention relates to such a walkway protection system which eliminates the need for heavier and thicker materials that are neither waterproof in their design nor installed in a watertight condition. The present invention provides an improved walkway protection system for new or existing EPDM roof sheeting material in areas subject to damage from regular maintenance work on serviceable rooftop Heating, Ventilating, and Air Conditioning (HVAC) equipment. The protective material is installed at access points to the roof, as well as to, around, and between serviceable HVAC equipment. These areas are subjected to either excessive amounts of foot traffic from trades conducting service work or sharp metal edges from access panel doors, tools, and discarded rooftop equipment parts.

2. Background Information

EPDM sheeting material has been used as single ply roofing membrane on low slope commercial and industrial buildings for a number of years. During that time, the majority of the EPDM membrane used as roofing material has been unreinforced and either 0.045" or 0.060" thick. Non-reinforced EPDM roofing in these thicknesses is resistant to degradation and damage from a variety of natural, as well as man-made, causes. However, even though non-reinforced EPDM has proven to be a reliable roofing material, non-reinforced EPDM roof sheeting that is 0.045" or 0.60" thick is susceptible to puncture and/or cuts in areas subjected to regular access by maintenance personnel. Punctures and cuts in the non-reinforced EPDM can be caused by hand tools, metal access panels on rooftop HVAC equipment, sharp debris, discarded HVAC parts, and regular foot traffic.

EPDM roof sheeting material has several attachment methods. The EPDM may be adhered directly to a suitable substrate, mechanically fastened over a suitable substrate or loose-laid and ballasted with stone ballast. The majority of EPDM roofing is loose-laid and ballasted. On exposed EPDM systems such as adhered and mechanically anchored, cuts and punctures are relatively easy to find and repair. However, on a stone ballasted system, a great deal of time and effort can be expended by laborers removing stones to discover a leak. In addition, a small puncture or cut may be obscured by the dirt that tends to collect below the stones over many years of exposure to airborne dirt and contaminants.

Various types of protective walkway systems are provided, as well as methods of installing the same, in order to provide a protective layer between the sources of cuts and punctures and the roofing membrane. One popular method is using concrete pavers, however, the concrete pavers have several disadvantages. First, the concrete pavers must be installed with a protective cushion layer of loose EPDM, or other suitable cushion material, between the concrete paver and the EPDM roof. Second, the concrete pavers do not have the same lifespan as the EPDM membrane. After twelve to fifteen years, the pavers spall, fracture, and create another source of membrane puncture. Third, if the concrete pavers are installed over field or flashing seams, then additional measures are required to protect the seam from the damp conditions that are created under the paver. Fourth, concrete pavers are heavy (approximately eighty pounds each) for laborers to lift and gently place on to the membrane. Fifth, responsible EPDM roofing manufacturers do not permit concrete pavers on mechanically anchored EPDM roofing systems because the systems billow and the pavers could become airborne during a wind event. Sixth, concrete pavers are usually permitted on adhered EPDM systems, however, they add weight to the roof and would still require a loose cushion layer between the paver and the membrane roof.

Additional current art to avoid puncture of the EPDM membrane in high traffic areas have several disadvantages. One material in current art is a square rubber mat that is spot adhered to the EPDM. The square mats are installed with gaps between the squares to facilitate drainage of water that collects on the roof surface. In addition, the mats are not waterproof themselves and are not installed in a waterproof condition. Current installation techniques for these square mats call for the mat to be adhered to the EPDM with either contact cement or peel and stick tape products. A second material consist of grounded-up rubber fragments that are bound together to form a roll. The roll of material is installed continuous, however, the material itself is not waterproof. In addition, the roll is not installed in a waterproof condition. The installation techniques would be similar to those described for the square mat. With either of these materials, a leak that occurs under the mat or roll is difficult to detect. A roof repair technician that is searching for a leak would not necessarily look under the current art walkway as these materials are supposed to protect the EPDM from puncture and damage.

In an effort to increase puncture resistance, as well as enhance other performance characteristics of the product, EPDM roofing manufacturers began manufacturing scrim reinforced EPDM. The scrim reinforced EPDM roof membrane has become a niche product and is used mainly in mechanically anchored EPDM roofing systems. This product is rarely used in either fully adhered or ballast EPDM roofing systems.

BRIEF SUMMARY OF THE INVENTION

Objectives of the invention include providing an improved continuous puncture resistant protective walkway system that is installed in a watertight condition and method of forming the same which eliminates the need for stone ballast around serviceable rooftop HVAC units, pathways between serviceable rooftop HVAC units, and pathways between roof access points and serviceable rooftop HVAC units.

A still further objective of the invention is to provides a continuous puncture resistant protective walkway system that is installed in a watertight condition which uses existing adhesives and caulking sealant materials which have been field tested and are compatible with each other and with the waterproof membrane, thereby eliminating possible harmful interaction between the various materials and the roofing membrane.

A still further objective of the invention is to provides a continuous puncture resistant protective walkway system that is installed in a watertight condition which can be performed easily by roofing personnel without requiring expensive equipment and skillful operations, and which can be accomplished in a relatively short period of time and with a minimum amount of materials, thereby reducing the cost of the roofing installation while providing an enhanced walkway system.

These objectives and advantages are further achieved by the improved method of the invention, the general nature of which may be stated as including a method of installing a continuous puncture resistant protective walkway system over new or existing waterproof roofing membrane including the steps of installing a layer of reinforced EPDM over new or existing EPDM; mechanically anchoring the new or existing EPDM with a metal, plastic, or reinforced EPDM strip and fasteners (Ballast system only); adhesively securing together the new reinforced EPDM to the new or existing non-reinforced EPDM using existing adhesive materials; and applying a bead of existing caulking sealant over the seam edge.

BRIEF DESCRIPTION OF THE SEVERAL VIEWS OF THE DRAWINGS

Similar numerals refer to similar parts throughout the drawings.

DETAILED DESCRIPTION OF THE INVENTION

Figure 1:
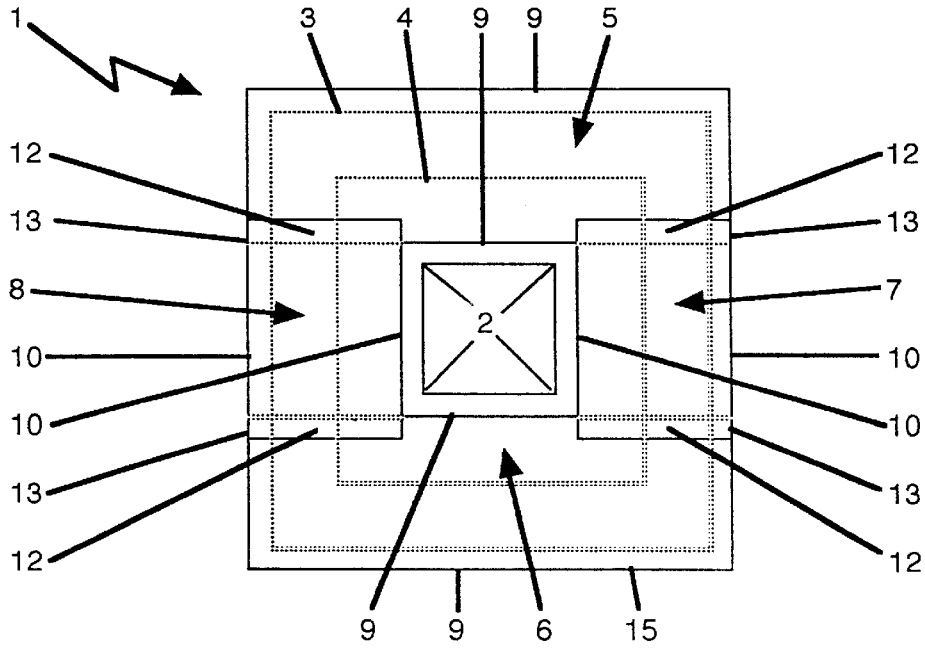
FIG. 1 is a plan view showing the improved reinforced EPDM walkway system around a rooftop HVAC unit with the non-reinforced new or existing EPDM excluded for clarity.
Figure 2:
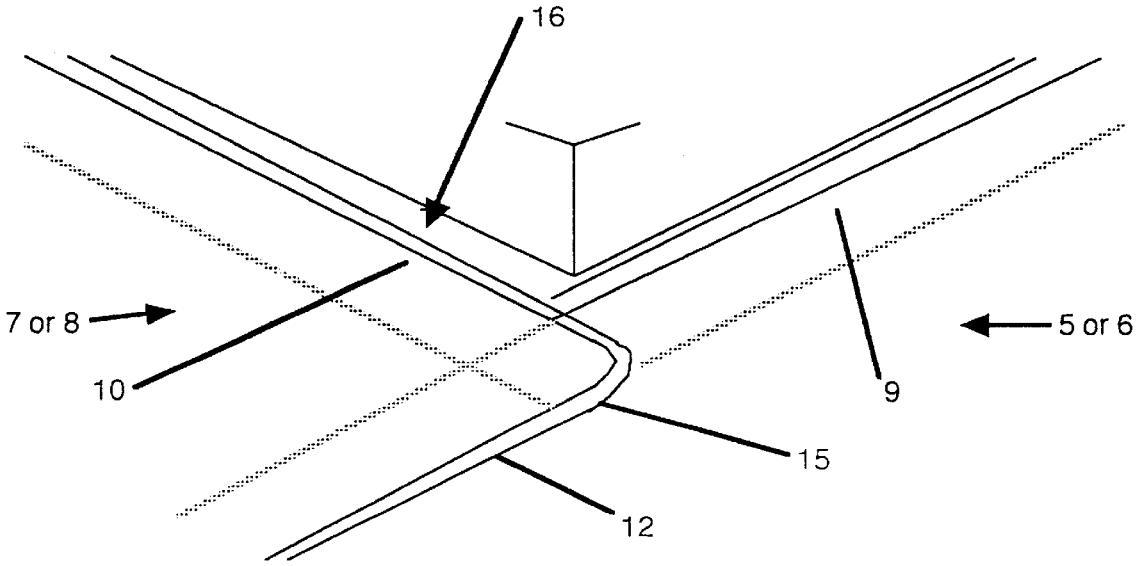
FIG. 2 is a fragmentary diagrammatic perspective view taken from a corner of 2 in FIG. 1.
Figure 3:
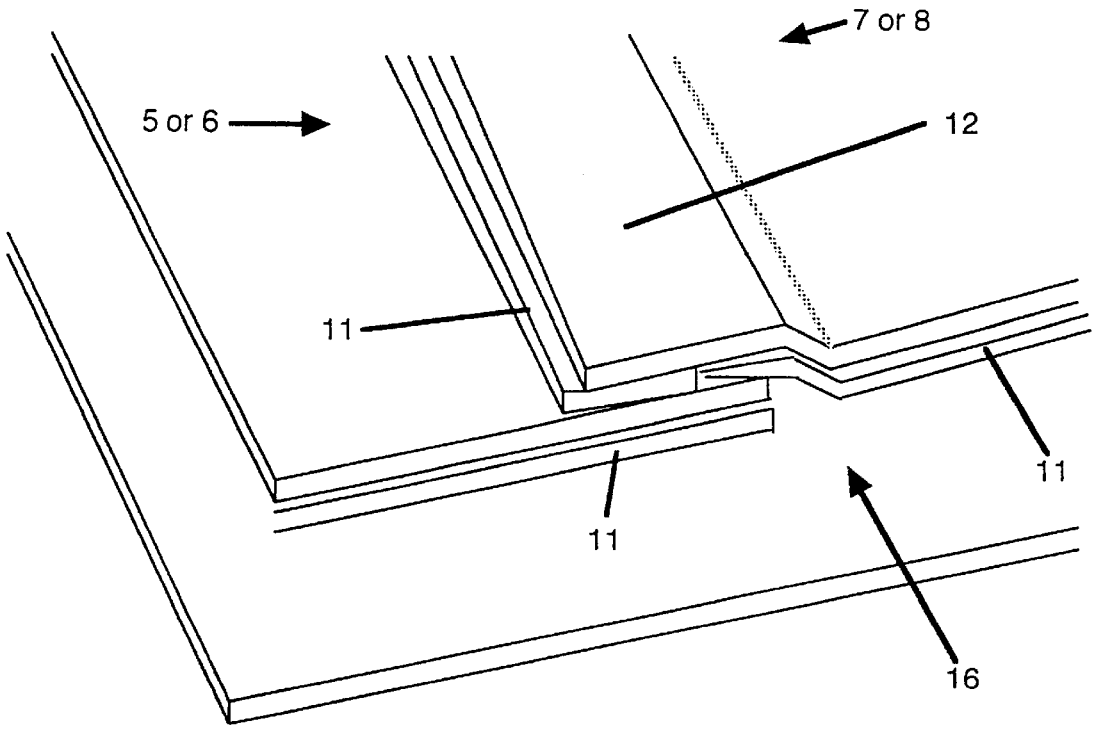
FIG. 3 is a fragmentary diagrammatic perspective view taken from 13 of FIG. 1.

FIG. 1 shows the walkway of the present invention with the new or existing nonreinforced EPDM roof excluded to clearly show the method of forming the walkway in accordance with the present invention. The improved walkway is indicated generally at 1, and is formed around the rooftop HVAC curb unit 2 in the center of the walkway. The improved walkway is formed by installing metal or plastic batten strips 3 and 4 in picture-frame fashion around the HVAC curb 2 and fastening the metal or plastic batten strip to the roof deck with appropriate fasteners (not shown for clarity). Metal or plastic batten strips are placed a minimum of six inches in from all outside edges of sheets 5, 6, 7, and 8. Four lengths of reinforced EPDM, 5, 6, 7, and 8, are cut to size and placed around the unit in sequence. Reinforced EPDM sheets 5 and 6 are approximately five feet wide and are preferably ten feet longer than the dimension of unit 2 along which they are installed. Reinforced EPDM sheets 7 and 8 are the same width as sheets 5 and 6 and are long enough to overlap a minimum of three inches on to both sheets 5 and 6. As shown in FIG. 2, the two long sections 5 and 6 are sealed to the new-or existing EPDM 16 at the overlap 9 and two short sections 7 and 8 at overlap 10, approximately three inches or more wide, using a layer of solid adhesive tape 11 indicated in FIG. 3. The layer of adhesive tape runs linearly along the entire perimeter edge of sheets 5 and 6. After a four hour curing period, sealant 15 is applied to the walkway perimeter. Reinforced EPDM sheets 7 and 8 are sealed to the new or existing non-reinforced EPDM 16 at 10 and to sheets 5 and 6 at 12 using the same layer of solid adhesive tape 11 indicated in FIG. 3. The layer of adhesive tape runs linearly along the entire perimeter edge of sheets 7 and 8. After a four hour curing period, sealant 15 is applied to the walkway perimeter seam edge.

Figure 4:
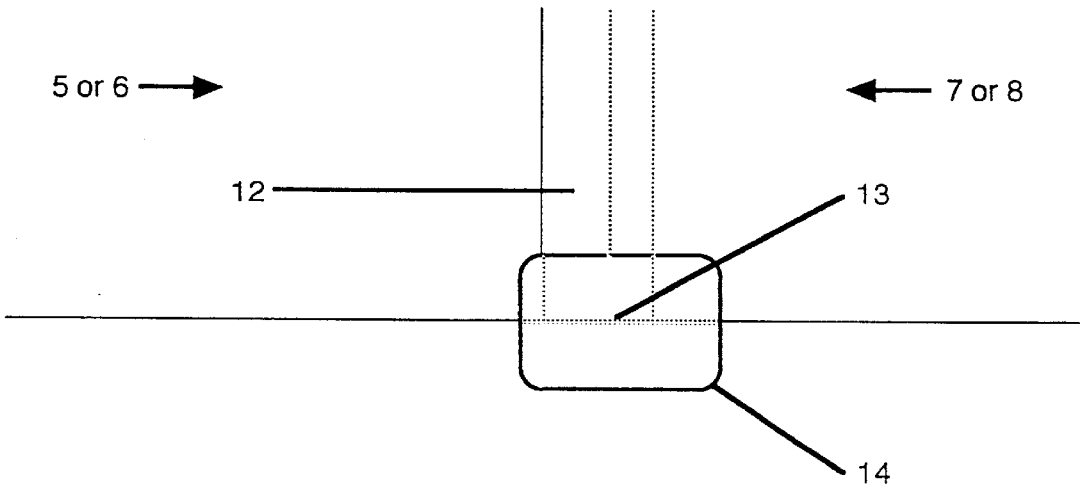
FIG. 4 is a fragmentary plan view perspective taken from 13 of FIG. 1.

FIG. 4 shows a joint cover 14 at overlap 13 where sheets 7 and 8 overlap sheets 5 and 6. At joint 13, a layer of flashing 14 that measures six inches wide by nine inches long is applied using adhesive 11 laminated to a compatible flashing material. After a four hour curing period, sealant 15 is applied to the joint cover perimeter seam edge.

In a preferred embodiment, reinforced EPDM 5, 6, 7, and 8 are formed of a reinforced EPDM or a similar type of waterproof membrane, with adhesive 11, used in forming seams 9, 10, and 12, being formed of a solid butyl-based adhesive tape. Adhesive 11 also can be a butyl-based contact adhesive without effecting the invention. The above described formation of seams 9, 10, and 12 is well known in the art.

Figure 5:
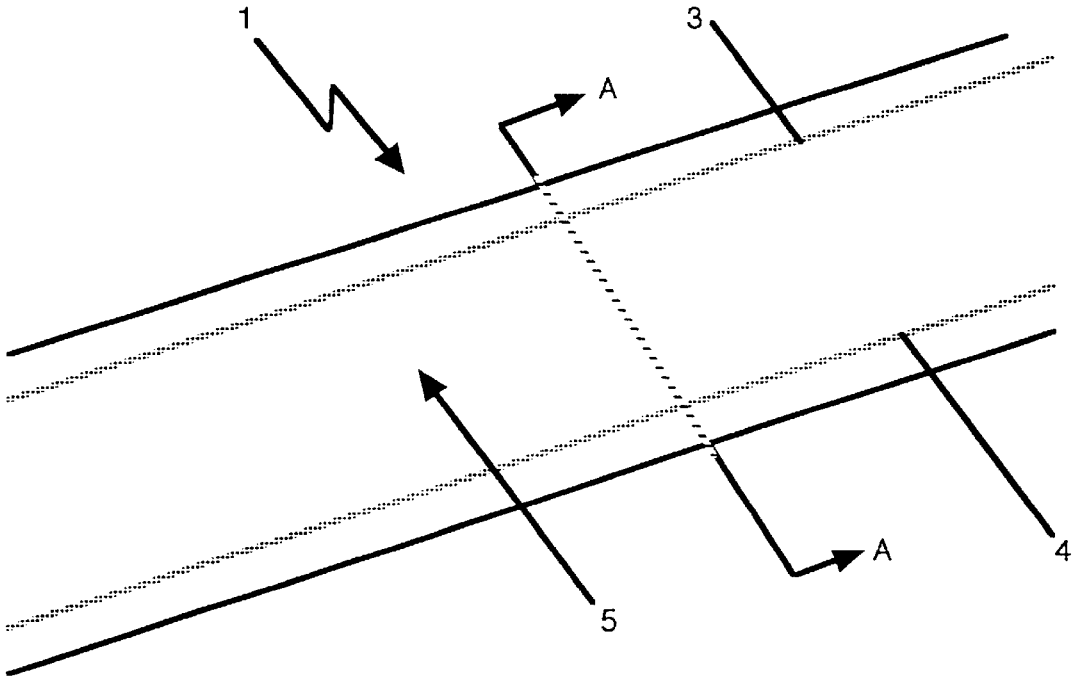
FIG. 5 is a fragmentary diagrammatic perspective view showing the improved reinforced EPDM walkway system between HVAC units and to and from roof access points.
Figure 6:
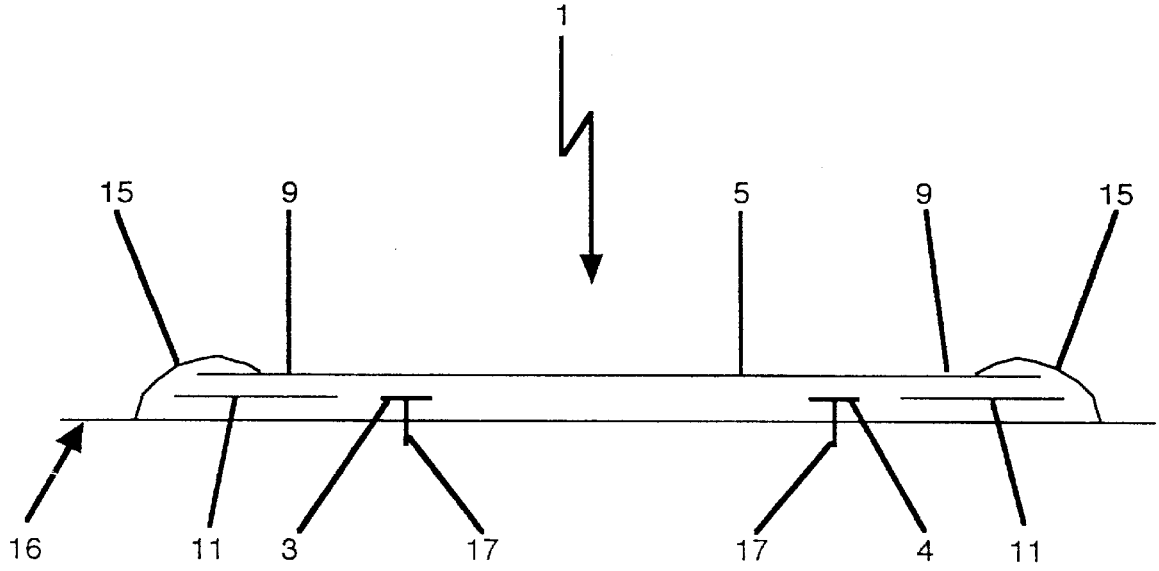
FIG. 6 is a sectional view taken on line A—A, FIG. 5.

FIGS. 5 and 6 shows the walkway of the present invention with the new or existing EPDM roof excluded from FIG. 5 to clearly show the method of forming the walkway in accordance with the present invention. The improved walkway is indicated generally at 1, and is formed between roof access points and serviceable rooftop HVAC units and between serviceable rooftop HVAC units. The improved walkway is formed by installing metal or plastic batten strips 3 and 4 in along the length required from the roof access point to serviceable rooftop HVAC units and between serviceable rooftop HVAC units. The metal or plastic batten strips 3 and 4 are fastened to the roof deck with appropriate fasteners 17 in FIG. 6. Metal or plastic batten strips are placed a minimum of six inches in from all outside edges of sheet 5. The metal or plastic battens are only required on ballast EPDM systems, although they may be placed over adhered and mechanically anchored EPDM systems as additional securement for the systems. A five foot wide (or other width), length of reinforced EPDM 5 is cut to length so that it extends from the roof access point to a serviceable rooftop HVAC unit or between serviceable rooftop HVAC units. As shown in FIG. 6, the reinforced EPDM sheet is placed over the lengths of metal or plastic batten and is sealed to the new or existing EPDM 16 using the same layer of solid adhesive tape 11 indicated in FIG. 3. The layer of adhesive tape runs linearly along the entire perimeter edge of sheet 5. After a four hour curing period, sealant 15 is applied to the walkway perimeter seam edge.

Thus, the improved reinforced EPDM walkway and method of the invention, provides an extremely satisfactory, long lasting, waterproof, and durable walkway, formed with a minimum number of components, all of which are readily compatible with each other, and which prevent punctures or cuts from penetrating the waterproof membrane under the walkway. Additionally, this improved walkway and method eliminates the use of stone ballast to, around, and between serviceable HVAC units on ballast EPDM systems which provides a smooth and durable walking and working surface for maintenance personnel.

Accordingly, the improved walkway and method-of the invention is simplified, provides an effective, safe, inexpensive, and efficient walkway and method which achieves all the enumerated objectives, provides for eliminating difficulties encountered with prior walkways, and solves problems and obtain new results in the art.

In the foregoing description, certain terms have been used for brevity, conciseness, and understanding; but no unnecessary limitations are to be implied therefrom beyond the requirement of the prior art, because such terms are used for for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the improved walkway and method is constructed and used, the characteristics of the construction and of the method, and the advantageous, new and useful results obtained; the new and useful structures, devices, elements, arrangements, parts, combinations, and method steps, are set forth in the appended claims.

What is claimed is:

1. A method of installing a waterproof, puncture-resistant and continuous walkway system over new or existing non-reinforced ethylene propylene diene monomer (EPDM) waterproof membrane roofing, including the steps of:

providing, installing and fastening a walkway anchor over a non-reinforced waterproof EPDM roofing membrane from roof access points to, around, and between serviceable rooftop heating, ventilation, and air conditioning (HVAC) units;

measuring and cutting a reinforced EPDM walkway material to walkway size;

placing the cut-to-size reinforced EPDM walkway material over said anchor from roof access points to, around, and between serviceable rooftop HVAC units;

adhesively securing and sealing the edges of the reinforced EPDM walkway material to the non-reinforced waterproof EPDM roofing membrane.

2. The method defined in claim 1, including overlapping the reinforced EPDM walkway about six inches past the fastened anchor in all directions.

3. The method defined in claim 1, including providing the adhesive as a solid.

4. The method defined in claim 1, including providing the adhesive as a liquid.

5. The method defined in claim 1, including forming the liquid sealant of EPDM or a butyl-based material.

6. The method defined in claim 1, including providing the anchor as a batten made of metal.

7. The method defined in claim 1, including providing the anchor as a batten made of plastic.

8. The method defined in claim 1, including providing the anchor as a strip made of reinforced EPDM.

9. The method defined in claim 1, including providing the reinforced EPDM in thickness from about 0.045 to about 0.060 inches.

10. The method defined in claim 1, including providing the reinforced EPDM to be installed over new or existing waterproof EPDM roofing membranes.

* * * * *